US008662204B2

(12) United States Patent
Kolev et al.

(10) Patent No.: US 8,662,204 B2
(45) Date of Patent: Mar. 4, 2014

(54) CORE BARREL RESTRAINT

(75) Inventors: Emil Kolev, Noarlunga Downs (AU); Nathan Kaesler, Prospect (AU)

(73) Assignee: Longyear TM, Inc., South Jordan, UT (US)

( * ) Notice: Subject to any disclaimer, the term of this patent is extended or adjusted under 35 U.S.C. 154(b) by 324 days.

(21) Appl. No.: 13/115,630

(22) Filed: May 25, 2011

(65) Prior Publication Data

US 2011/0297444 A1 Dec. 8, 2011

Related U.S. Application Data

(60) Provisional application No. 61/351,540, filed on Jun. 4, 2010.

(51) Int. Cl.
*E21B 49/02* (2006.01)

(52) U.S. Cl.
USPC ..... 175/58; 175/244; 175/424

(58) Field of Classification Search
USPC ..... 175/58, 244–255, 320, 325.1, 325.2, 175/325.5–325.7, 424; 403/220, 291
See application file for complete search history.

(56) References Cited

U.S. PATENT DOCUMENTS

| | | | | | |
|---|---|---|---|---|---|
| 565,745 | A | * | 8/1896 | Harris | 111/101 |
| 862,840 | A | * | 8/1907 | Nelson et al. | 248/60 |
| 3,224,185 | A | * | 12/1965 | Grim et al. | 59/86 |
| 3,249,370 | A | * | 5/1966 | Brogden | 285/81 |
| 3,499,103 | A | * | 3/1970 | Pearce | 174/135 |
| 3,813,733 | A | * | 6/1974 | Flohr | 285/117 |
| 3,977,482 | A | * | 8/1976 | Reed et al. | 175/246 |
| 3,988,906 | A | * | 11/1976 | Smith | 464/88 |
| 4,588,036 | A | | 5/1986 | Desrochers et al. | |
| 4,947,779 | A | * | 8/1990 | Grinde | 114/250 |
| 6,006,844 | A | | 12/1999 | Van Puymbroeck et al. | |
| 2006/0169493 | A1 | | 8/2006 | Kadomoto et al. | |
| 2010/0059635 | A1 | * | 3/2010 | Schiefelbein, Jr. | 248/60 |

OTHER PUBLICATIONS

International Search Report for International Application No. PCT/US2011/038572 (mailed Feb. 9, 2012).

* cited by examiner

*Primary Examiner* — Kenneth L Thompson
*Assistant Examiner* — Blake Michener
(74) *Attorney, Agent, or Firm* — Ballard Spahr LLP

(57) ABSTRACT

A core barrel restraint adapted to prevent inadvertent dropping of a core barrel assembly during retrieval of a core sample can include a cup adapted to fit over an overshot and a brace adapted to be coupled to a core barrel assembly. A cable can connect the cup and brace and prevent the core barrel from falling if the overshot latch mechanism holding the core barrel assembly and overshot together fails.

20 Claims, 10 Drawing Sheets

CORE BARREL RESTRAINT

CROSS-REFERENCE TO RELATED APPLICATIONS

This application claims priority to and the benefit of U.S. Provisional Application No. 61/351,540, filed Jun. 4, 2010, entitled "Core Barrel Restraint." The contents of the above-referenced patent application are hereby incorporated by reference in their entirety.

BACKGROUND OF THE INVENTION

1. The Field of the Invention

The present invention relates generally to drilling devices and methods. In particular, the present invention relates to devices to prevent a core barrel from falling when being handled outside of a drill string.

2. The Relevant Technology

Core drilling (or core sampling) includes obtaining core samples of subterranean formations at various depths for various reasons. For example, a retrieved core sample can indicate what materials, such as petroleum, precious metals, and other desirable materials, are present or are likely to be present in a particular formation, and at what depths. In some cases, core sampling can be used to give a geological timeline of materials and events. As such, core sampling may be used to determine the desirability of further exploration in a particular area.

Wireline drilling systems are one common type of drilling system for retrieving a core sample. In a wireline drilling process, a core drill bit is attached to the leading edge of an outer tube or drill rod. A drill string is then formed by attaching a series of drill rods that are assembled together section by section as the outer tube is lowered deeper into the desired formation. A core barrel assembly is then lowered or pumped into the drill string.

Core barrel assemblies commonly include a core barrel for receiving the core, and a head assembly for attaching the core barrel assembly to the wireline. Typically, the core barrel assembly is lowered into the drill string until the core barrel reaches a landing seat on an outer tube or distal most drill rod. At this point a latch on the head assembly is deployed to restrict the movement of the core barrel assembly with respect to the drill rod. Once latched, the drill string is rotated, pushed, and/or vibrated into the formation, thereby causing a sample of the desired material to enter into the core barrel assembly.

Once the core sample is obtained, the core barrel assembly is retrieved from the drill string to obtain the core sample. Often a wireline assembly is used to remove the core barrel (and core sample) from the bottom of the drill string. For example, a wireline may be connected to an overshot assembly. The overshot can engage a spearhead assembly that is connected to the core barrel assembly. The overshot typically connects to spearhead assembly via an overshot latch mechanism, which allows the core barrel to be retrieved when the wireline is retracted. When the overshot and core barrel are within the drill string, the alignment between the overshot and core barrel is constrained, which allows the overshot latch mechanism to function correctly.

When retrieving a core sample, the wireline and hoist often elevate the core barrel assembly until it is completely extracted from the drill string. Once extracted from the drill string, the lower end of the core barrel assembly may be moved away from the borehole and the core sample retrieved. Once the overshot and the core barrel assembly are removed from the drill string, alignment between the overshot and the core barrel assembly may not be maintained. It is possible that extra loading may be applied to the overshot latch mechanism as the core barrel assembly is maneuvered away from the drill mast. The extra loading and/or misalignment of the overshot and the core barrel assembly may cause the overshot latch mechanism to fail. In the event that the overshot latch mechanism fails, the core barrel assembly can fall uncontrollably. Due to the close proximity of the drill operators to the drill string and retrieved core barrel, if a core barrel assembly falls there may be a high possibility of injuring an operator. Furthermore, a dropped core barrel assembly can damage the drilling equipment and/or the retrieved core sample.

Accordingly, there are a number of disadvantages in conventional core barrel retrieval systems and methods that can be addressed.

BRIEF SUMMARY OF THE INVENTION

One or more implementations of the present invention solve one or more of the forgoing, or other, problems in the art with systems, methods, and apparatus configured to prevent a core barrel assembly from unintentionally detaching from an overshot assembly. In particular, a core barrel restraint of one or more implementations of the present invention can provide a secondary mechanism for attaching an overshot assembly to a core barrel assembly. The core barrel restraint can prevent the core barrel assembly from falling in the event that the overshot latch mechanism fails during handling of the core barrel assembly. Thus, one or more implementations of the present invention can help prevent damage or injury to a core sample, a core barrel assembly, and/or drill operators.

For example, an implementation of a core barrel restraint assembly can include a brace adapted to attach to a core barrel assembly. The core barrel restraint assembly can also include a cup adapted to attach to an overshot assembly. Furthermore, the core barrel restraint assembly can include a cable connecting the brace to the cup. The brace, cup, and cable can prevent the core barrel assembly from unintentionally failing in the event that the overshot latch mechanism fails.

Additionally, an implementation of a drilling system can include a core barrel assembly and an overshot assembly. The overshot assembly can have an overshot latch mechanism adapted to couple the overshot to the core barrel assembly. The drilling system can also include a core barrel restraint. The core barrel restraint can include a cup, a brace, and a cable coupling the brace and the cup together. The cup can be secured about the overshot. The brace can be secured to the core barrel assembly.

In addition to the foregoing, an implementation of a method of retrieving a core sample can involve retracting an overshot and a core barrel assembly from a drill string until at least a portion of the core barrel assembly is removed from the drill string. The method can also involve securing a cup about the overshot. Additionally, the method can involve securing a brace to the core barrel assembly. The brace can be secured to the cup via a cable.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to systems, methods, and apparatus configured to prevent a core barrel assembly from unintentionally detaching from an overshot assembly. In particular, a core barrel restraint of one or more implementations of the present invention can provide a secondary mechanism for attaching an overshot assembly to a core barrel assembly. The core barrel restraint can prevent the core barrel assembly from falling in the event that the overshot latch mechanism fails during handling of the core barrel assembly. Thus, one or more implementations of the present invention can help prevent damage or injury to a core sample, a core barrel assembly, and/or drill operators.

In one or more implementations the core barrel restraint can include a cup adapted to fit over an overshot assembly and a brace adapted to be coupled to a core barrel assembly. The core barrel restraint can also include a locking mechanism adapted to hold the brace and core barrel assembly together. A cable can connect the cup and brace and prevent the core barrel assembly from falling if the overshot latch mechanism holding the core barrel assembly to the overshot fails.

Figure 1:
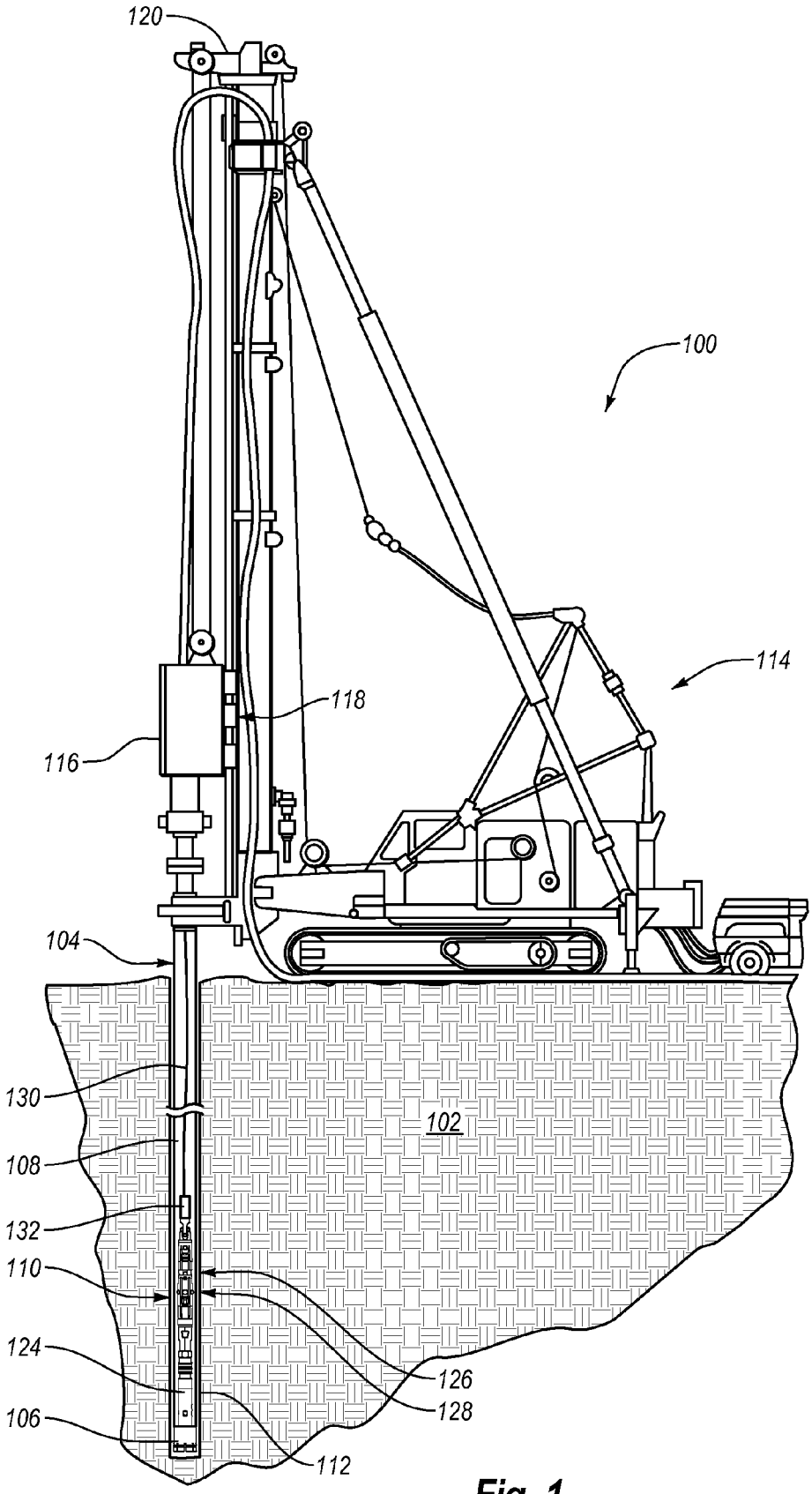
FIG. 1 illustrates a drilling system with which a core barrel restraint can be used in accordance with an implementation of the present invention.

As shown in FIG. 1, a drilling system 100 may be used to retrieve a core sample from a formation 102. The drilling system 100 may include a drill string 104 that may include a drill bit 106 (for example, an open-faced drill bit or other type of drill bit) and/or one or more drill rods 108. The drilling system 100 may also include an in-hole assembly, such as a core barrel assembly 110. The core barrel assembly 110 can include a core barrel latch mechanism 128 configured to lock the core barrel assembly at least partially within a distal drill rod or outer tube 112. As used herein the terms "down" and "distal end" refer to the end of the drill string 104 including the drill bit 106. While the terms "up" or "proximal" refer to the end of the drill string 104 opposite the drill bit 106.

The drilling system 100 may include a drill rig 114 that may rotate and/or push the drill bit 106, the core barrel assembly 110, the drill rods 108 and/or other portions of the drill string 104 into the formation 102. The drill rig 114 may include, for example, a rotary drill head 116, a sled assembly 118, and a mast 120. The drill head 116 may be coupled to the drill string 104, and can allow the rotary drill head 116 to rotate the drill bit 106, the core barrel assembly 110, the drill rods 108 and/or other portions of the drill string 104. If desired, the rotary drill head 116 may be configured to vary the speed and/or direction that it rotates these components. The sled assembly 118 can move relative to the mast 120. As the sled assembly 118 moves relative to the mast 120, the sled assembly 118 may provide a force against the rotary drill head 116, which may push the drill bit 106, the core barrel assembly 110, the drill rods 108 and/or other portions of the drill string 104 further into the formation 102, for example, while they are being rotated.

It will be appreciated, however, that the drill rig 114 does not require a rotary drill head, a sled assembly, a slide frame or a drive assembly and that the drill rig 114 may include other suitable components. It will also be appreciated that the drilling system 100 does not require a drill rig and that the drilling system 100 may include other suitable components that may rotate and/or push the drill bit 106, the core barrel assembly 110, the drill rods 108 and/or other portions of the drill string 104 into the formation 102. For example, sonic, percussive, or down hole motors may be used.

The core barrel assembly 110 may include an inner tube or core barrel 124, and a head assembly 126. The drilling system 100 can also include a wireline 130 and an overshot assembly 132. The core barrel 124 can be coupled to the head assembly 126, which in turn can be removably coupled to the overshot assembly 132 via an overshot latch mechanism (see FIG. 2). The overshot assembly 132 can in turn be coupled to a wireline 130. The wireline 130 can be used to lower the core barrel assembly 110 into position within the drill string 104. Alternatively, the core barrel assembly 110 can be pumped or dropped into position within the drills string 104.

The core barrel latch mechanism 128 can lock the core barrel 124 within the drill string 104, and particularly to the outer tube 112. Once the core barrel 124 is locked to the outer tube 112 via the core barrel latch mechanism 128, the overshot assembly 132 can be actuated to disengage the head assembly 126 (i.e., the over shot latch mechanism can be released). The overshot assembly 132 can then optionally be removed from the drill string 104.

The drill bit 106, the core barrel assembly 110, the drill rods 108 and/or other portions of the drill string 104 may be rotated and/or pushed into the formation 102 to allow a core sample to be collected within the core barrel 124. After the core sample is collected, the core barrel assembly 110 may be unlocked from the outer tube 112 and drill string 104. To retrieve the core barrel assembly 110, the wireline 130 can lower the overshot assembly 132 onto the head assembly 126. The overshot latch mechanism (see FIG. 2) can lock the overshot assembly 132 to the head assembly 126. The wireline 130 can then be refracted using a wench or other mechanism, thereby pulling the overshot assembly 132 and the core barrel assembly 110 to the surface. Once the core barrel assembly 110 is tripped from the drill string 104, an operator can move the core barrel assembly away from the borehole. At his point, the core barrel 124 containing the core sample may be removed from the core barrel assembly 110 and the core sample retrieved.

Figure 2:
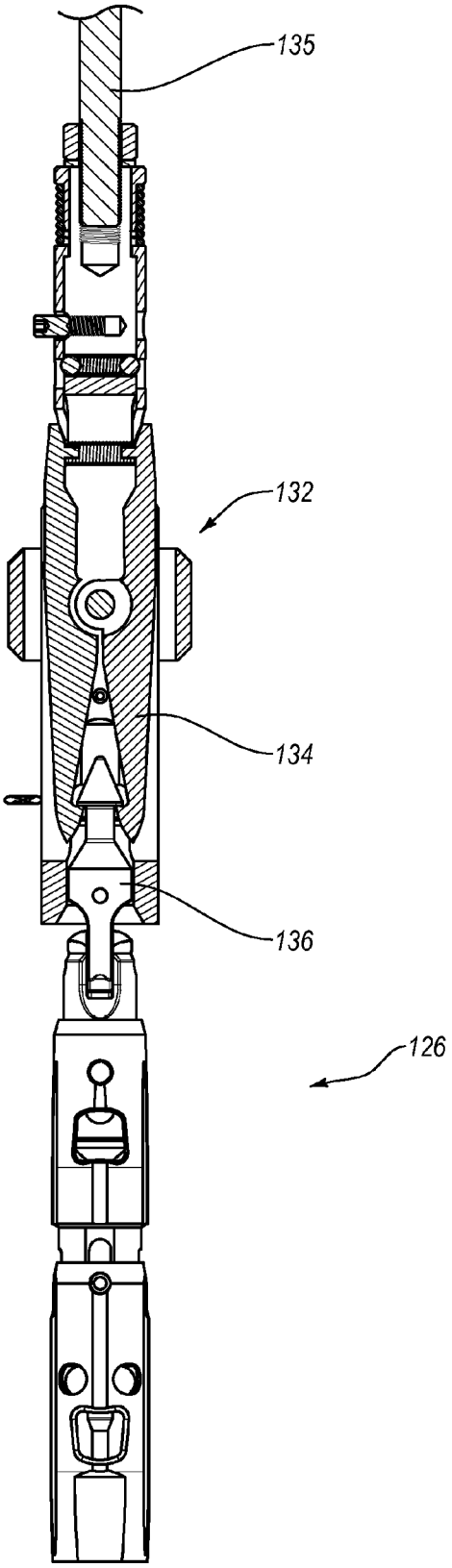
FIG. 2 illustrates a partial cross-sectional view of an overshot assembly secured to a core barrel assembly in accordance with an implementation of the present invention.
Figure 5A:
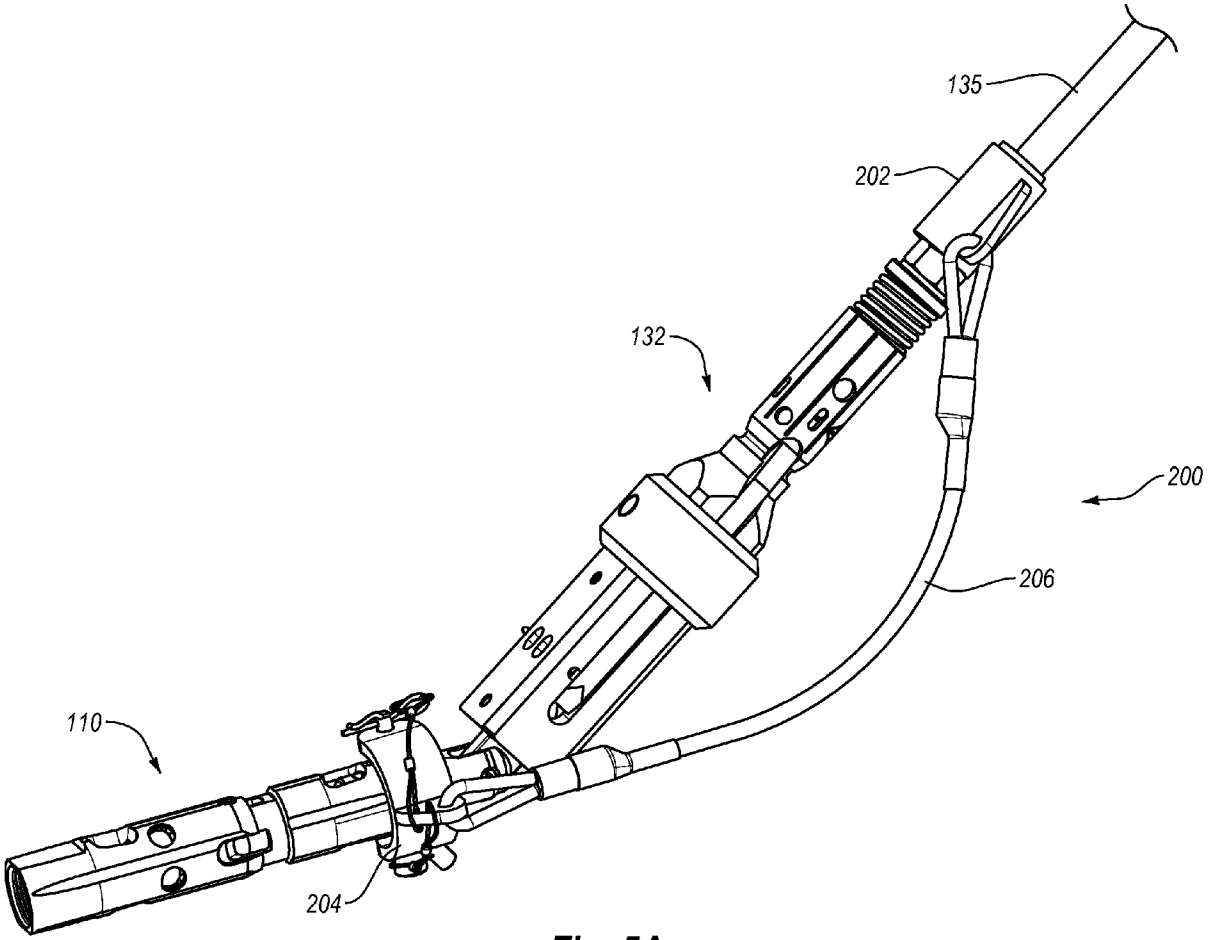
FIG. 5A illustrates a perspective view of the core barrel restraint of FIG. 3 secured to an overshot assembly and core barrel assembly in accordance with an implementation of the present invention, albeit with the overshot assembly and core barrel assembly out of alignment.
Figure 5B:
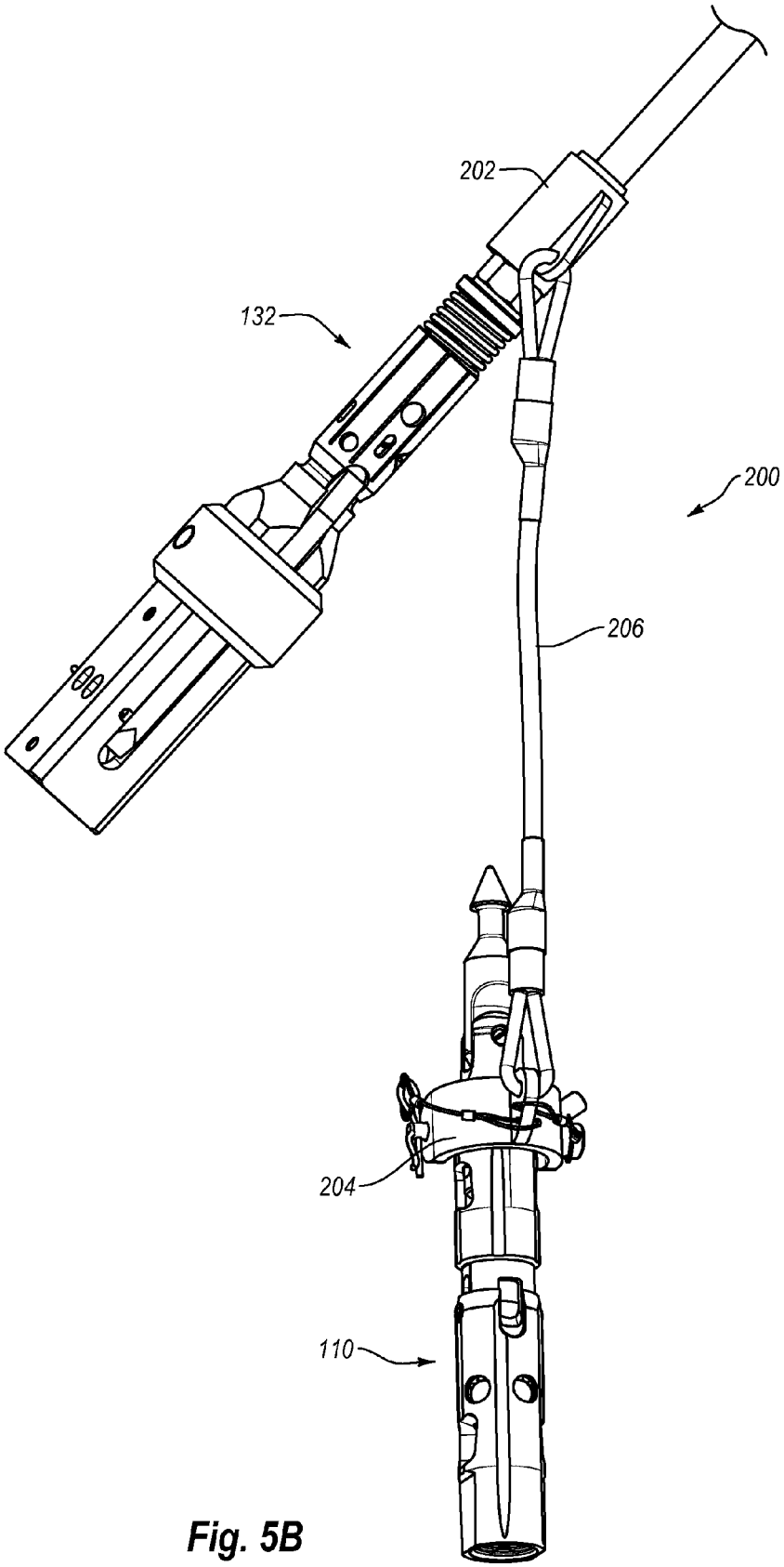
FIG. 5B illustrates a perspective view of the core barrel restraint of FIG. 3 securing a core barrel assembly to an overshot with the overshot latch mechanism disengaged in accordance with an implementation of the present invention.

FIG. 2 illustrates a partial cross-sectional view of the overshot assembly 132 of FIG. 1 secured to the core barrel assembly 110 of FIG. 1. FIGS. 2 and 5A-5B illustrate only the head assembly 126 of the core barrel assembly 110 for clarity and to aid in description. One will appreciate, however, that a core barrel 124 can be coupled to the distal end of the head assembly 126 as described and shown in relation to FIG. 1.

The overshot assembly 132 can include an overshot latch mechanism 134 and a rod 135. The rod 135 of the overshot can be coupled to the wire line 130 (see FIG. 1). FIG. 2 illustrates that the overshot latch mechanism 134 can include spring-loaded tongs. In alternative implementations, the overshot latch mechanism 134 can include other mechanical mechanisms or hydraulic mechanisms for attaching to the core barrel assembly 110.

In any event, the overshot latch mechanism 134 can couple to the head assembly 126 of the core barrel assembly 110. For example, FIG. 2 illustrates that the head assembly can include a spearhead 136. The overshot latch mechanism 134 can engage and capture the spearhead 136 to attach to the core barrel assembly 110.

As previously mentioned, when the overshot assembly 132 and the core barrel assembly 110 are within the drill string 104, the drill string 104 can ensure that the overshot assembly 132 and the core barrel assembly 110 are aligned with each other. Proper alignment between the overshot assembly 132 and the core barrel assembly 110 can help ensure that the overshot latch mechanism 134 does not experience increased loading or other conditions that can increase the likelihood of failure. Once the removed from the drill string 104, however, the core barrel assembly 110 may be free to move out of alignment with the overshot assembly 132, increasing the likelihood of the overshot latch mechanism 134 failing.

Figure 3:
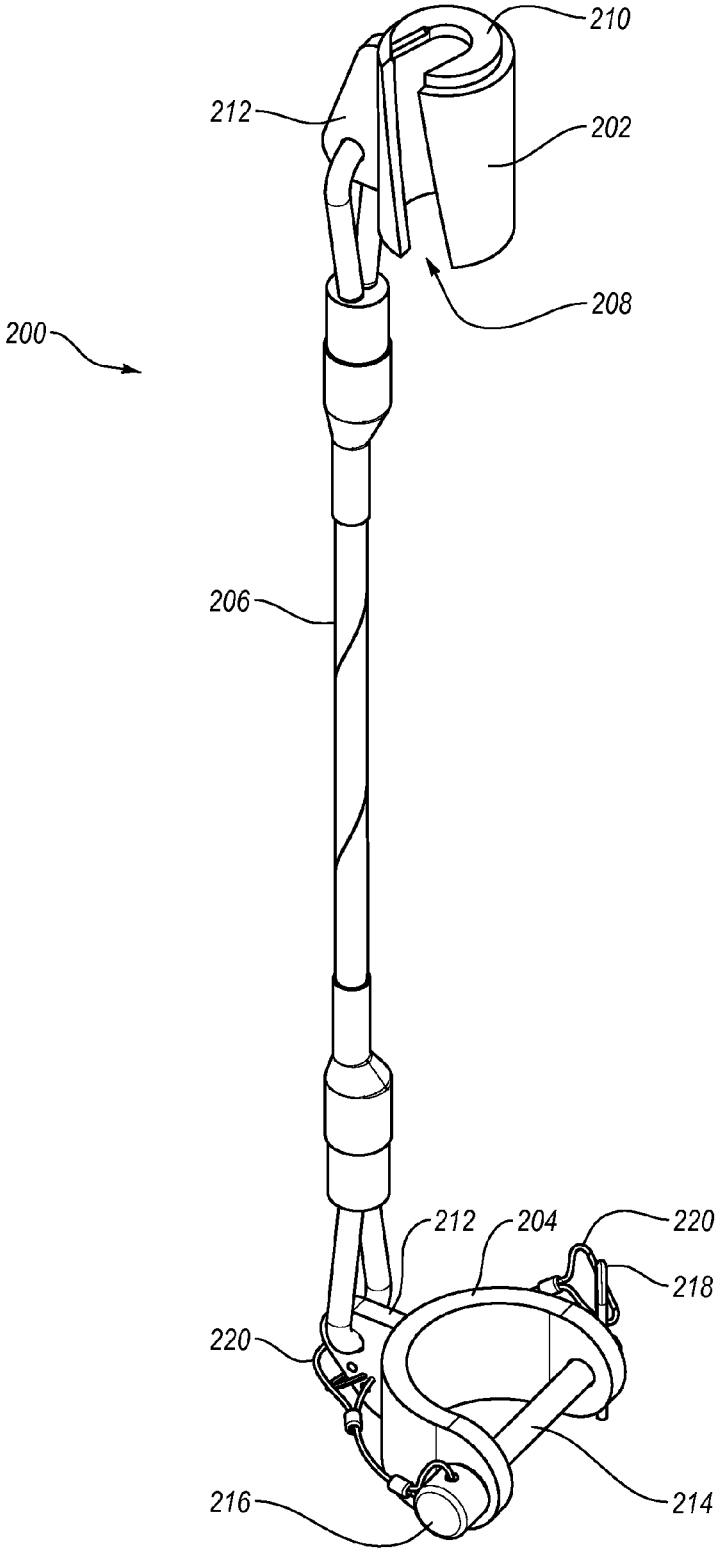
FIG. 3 illustrates a perspective view of a core barrel restraint in accordance with an implementation of the present invention.

FIG. 3 illustrates a perspective view of a core barrel restraint 200 that may be used to ensure that the core barrel assembly 110 does not fall uncontrollably upon failure of the overshot latch mechanism 134. Thus, the core barrel restraint 200 can function as a secondary attachment between the core barrel assembly 110 and the overshot assembly 132, which an operator can attached when handling the core barrel assembly out of the bore hole.

As shown by FIG. 3 the core barrel restraint 200 can include a cup 202 secured to a brace 204 via a cable 206. The cup 202 can be configured to couple to an overshot assembly 132. The cup 202 can thus comprise any number of mechanisms that allow for coupling to an overshot assembly 132. For example, FIG. 3 illustrates that in one or more implementations the cup 206 can comprise a generally hollow cylinder with an angled slot 208.

As explained in greater detail below, an operator can insert a portion of the overshot assembly 132, such as the rod 135, into the angled slot 208 of the cup 202 to couple the cup 206 to the overshot assembly 132. Once positioned about the overshot assembly 132, a retaining plate 210 can engage the top of the overshot assembly 132 and secure the cup 202 thereto. Additionally, the cup 202 can optionally include a cable attachment flange 212, or other mechanism, configured to secure the cable 206 to the cup 202.

The brace 204 can be coupled to a core barrel assembly 110, head assembly 126, or other component on the opposite side of the overshot latch mechanism 134 connecting the core barrel assembly 110 and the overshot assembly 126. For ease in description, the brace 204 will be described herein below as being attached to the core barrel assembly 110. One will appreciate in light of the disclosure herein that the brace 204 can similarly be secured to the head assembly 126 or other component of the core barrel assembly 110. In particular, as explained in greater detail below, the brace 204 can be configured to at least partially surround the core barrel assembly 110. The brace 204 can include corresponding holes through which a pin 214 may pass. The pin 214 can be inserted in the holes and through a channel within the core barrel assembly 110. The pin 214 can secure the brace 204 to the core barrel assembly 110.

To help ensure that the pin 214 is not inadvertently pulled from the brace 204 and/or core barrel assembly 110, the pin 214 can include a head 216 at one end, and a safety clip 218 at the other. Both the pin 214 and the safety clip 218 can be secured to the brace 204 via tethers 220, 222. Similar to the cup 202, the restraint 204 can include a cable attachment flange 212 configured to secure the cable 206 to the restraint 204.

The cable 206 can comprise a reinforced steel cable. In some implementations, the cable 206 can include a protective cover. One will appreciate that the cable 206 can provide a connection between the cup 202 and the brace 204 that can be tested and certified. This can allow a designer to ensure the core barrel restraint 200 has an adequate safety factor.

Figure 4:
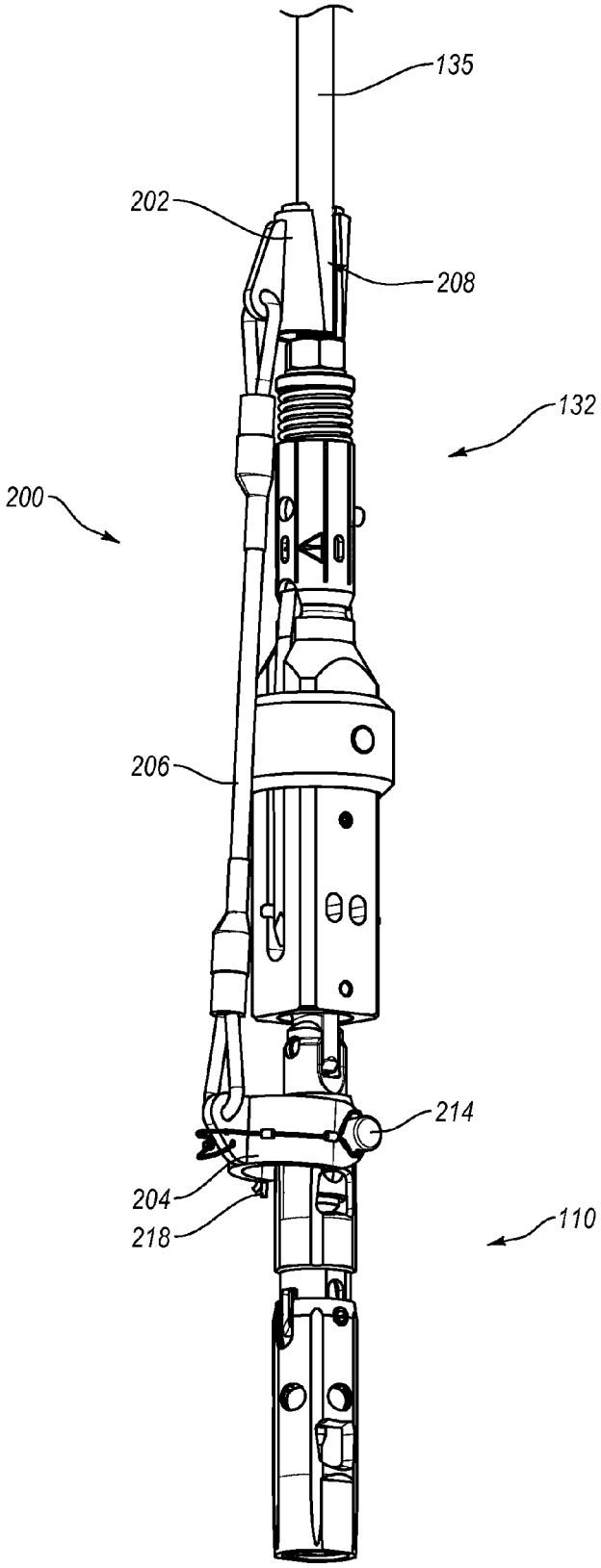
FIG. 4 illustrates a perspective view of the core barrel restraint of FIG. 3 secured to an overshot assembly and core barrel assembly in accordance with an implementation of the present invention.

Use of the core barrel restraint 200 will now be described in relation to FIGS. 4-5B. With reference to FIG. 4, once the top of the core barrel assembly 110 is retracted from the drill string 104 or just before, an operator can obtain the core barrel restraint 200 from its storage position. The operator can then position the cup 202 on the overshot assembly 132 by inserting the rod 135 into the angled slot 208, as shown in FIG. 4. The operator can then slide the cup 202 along the rod 135 until the retaining plate 210 engages the top portion, or jar bar section, of the overshot assembly 132. In alternative implementations, the operator can secure the cup 202 to the wireline 130 and slide the cup 202 along the wireline 130 until engagement with the overshot assembly 132.

Next the operator can secure the brace 204 to the core barrel assembly 110. In particular, the operator can position the brace 204 about the core barrel assembly 110 (or head assembly 126) so that the core barrel assembly 110 is positioned at least partially within the brace 204. Additionally, the operator can align the pin holes of the brace 204 with a channel or through-hole in the core barrel assembly 110, as shown by FIG. 4. The operator can then insert the pin 214 through a first side of the brace 204, through the channel or through-hole of the core barrel assembly 110, and through the opposing side of the brace 204.

In order to lock the pin 214 within the core barrel assembly 110 and brace 204, the operator can insert a safety clip 218, such as the R-clip through a hole in the end of the pin 214 opposite the head 216. The safety clip 218 can prevent the pin 214 from being inadvertently pulled out of the brace 204 and/or core barrel assembly 110. One will appreciate in light of the disclosure herein that in at least one implementation, the core barrel restraint 200 can be configured so that no appreciable load is transferred to the safety clip 218. Instead, the forces and stress associated with restraining the core barrel assembly 110 can be transferred to the pin 214. Furthermore, the brace 204 and pin 214 can be configured such that the pin 214 is loaded in double shear. A high strength steel construction and double shear loading can allow the pin 214 to withstand substantial amounts of stress without failing.

Once the core barrel restraint 200 is properly secured to the core barrel assembly 110, the wireline 130 can be raised and the core barrel assembly 110 can be fully tripped from the drill string 104. Furthermore, as shown by FIG. 5A, the core barrel restraint 200 can secure the core barrel assembly 110 to the overshot assembly 132 irrespective of the orientation and alignment of the overshot assembly 132 and the core barrel assembly 110. Thus, the operator can guide the core barrel assembly 110 down to ground level without the chance of the core barrel assembly 110 falling uncontrollably in the event of the overshot latch mechanism 134 failing.

Figure 6:
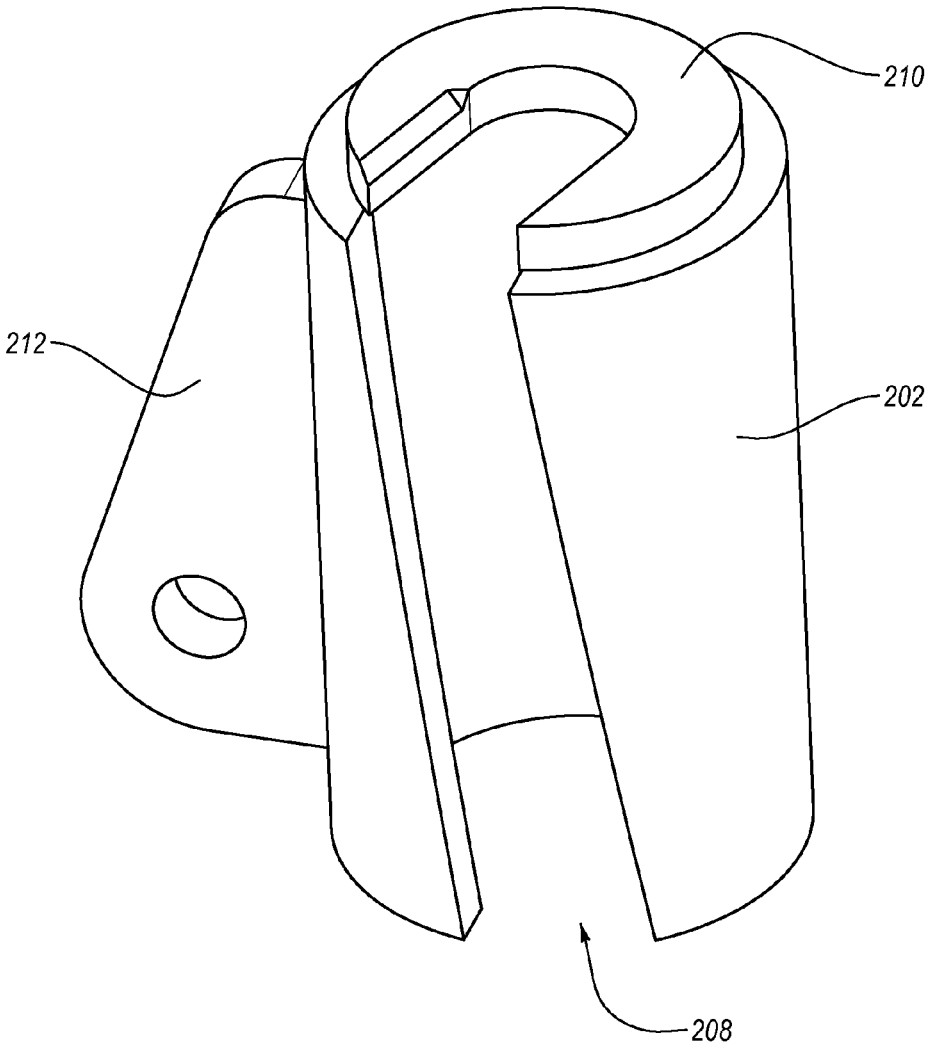
FIG. 6 illustrates a perspective view of a cup of a core barrel restraint in accordance with an implementation of the present invention.
Figure 7:
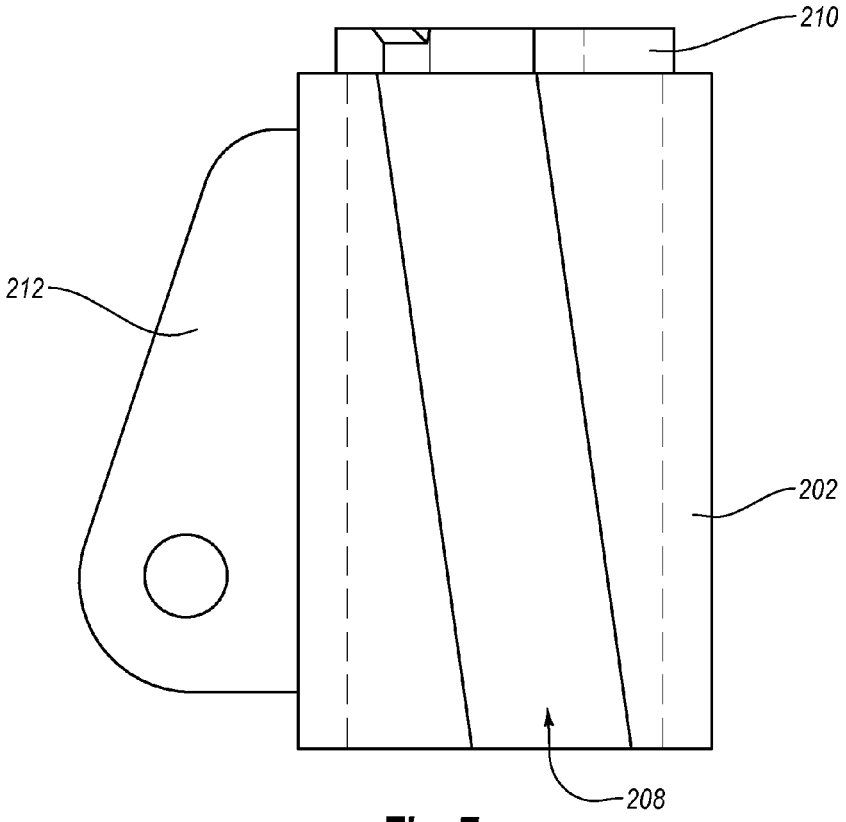
FIG. 7 illustrates a side elevational view of the cup of FIG. 6.
Figure 8:
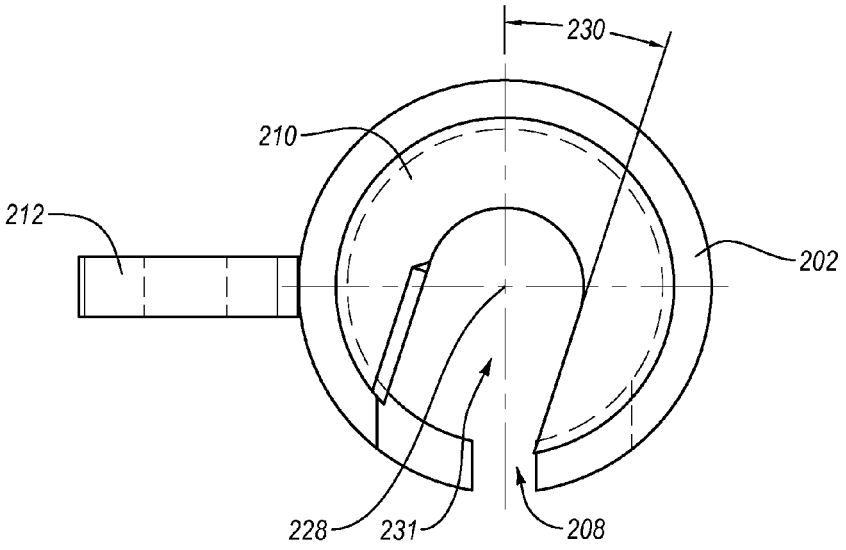
FIG. 8 illustrates a top plan view of the cup of FIG. 6.

FIG. 5B illustrates that the core barrel restraint 200 can secure the core barrel assembly 110 to the overshot assembly 132 even if the overshot latch mechanism 134 between the core barrel assembly 110 and overshot assembly 132 fails or otherwise releases. The core barrel restraint 200 can prevent thus the core barrel assembly 100 from falling in the event that the overshot latch mechanism 134 fails during handling of the core barrel assembly 110. Thus, one or more implementations of the present invention can help prevent damage or injury to a core sample, a core barrel assembly, and/or drill operators Referring now to FIGS. 6-8 a number of features of the cup 202 will be described in greater detail. FIGS. 6-8 illustrates perspective, side, and top views, respectively, of the cup 202. As previously mentioned, the cup 202 can include an angled slot 208, a retaining plate 210, and an attachment flange 212. The cup 202 can comprise a high strength material, such as, for example, steel or other alloys or metals. In some implementations, the retaining plate 210 and an attachment flange 212 can be welded to the body of the cup 202.

As shown by FIGS. 7 and 8, the angled channel 208 can be offset from the central axis 228 of the cup 202. The angular orientation of the channel 208 can ensure that cup 202 is not inadvertently released from the rod 135 or wireline 130. The angular configuration or offset of the channel 208 from the central axis 228 can thus help prevent the rod 135 or wireline 130 from exiting from the channel 208 when engaged with the overshot assembly 132.

In particular, as shown by FIG. 8 in some implementations the angular channel 208 can be offset from the central axis 228 of the cup 220 by an angle 230. In some implementations, the angle 230 can comprise between about 5 degrees and about 40 degrees. In further implementations, the angle 230 can comprise between about 15 degrees and about 25 degrees. In yet further implementations, the angle 230 can comprise about 18 degrees. As shown by FIG. 7, the angled slot 208 can extend from the top of the cup 202 to the bottom of the cup 202.

One will appreciate in light of the disclosure herein that the cup 202 can be configured to hold the rod 135 or wireline 130 substantially along its central axis 228. In particular, the retaining plate 210 can include a slot 231 that extends from the slot 208 and about the central axis 228 of the cup 202. An operator can angle the cup 202 relative to the wireline 130 or rod 135 to insert the wireline 130 or rod 135 into the cup 202. Once the wireline 130 or rod 135 is inserted within the cup 202, the slot 231 of the retaining plate 210 can cause the wireline 130 or rod 135 to be positioned substantially along the central axis 228 of the cup 202. When the wireline 130 or rod 135 is positioned along the central axis 228 of the cup 202, the angular configuration of the slot 208 can prevent the wireline 130 or rod 135 from exiting the cup 202.

One will appreciate in light of the disclosure herein that the cup 202 can allow an operator to quickly and easily attach the core barrel restraint 200 to an overshot assembly 132 or wireline 130. In particular, the angled slot 208 and retaining plate 210 can allow an operator to couple the cup 202 to an overshot assembly 132 or wireline 130 without the use of any fasteners, such as threaded interfaces, or other devices. Indeed, as discussed above, an operator need only slip the cup 202 about an overshot assembly 132 or wireline 130 to attach the cup 202 to the overshot assembly 132.

Figure 9:
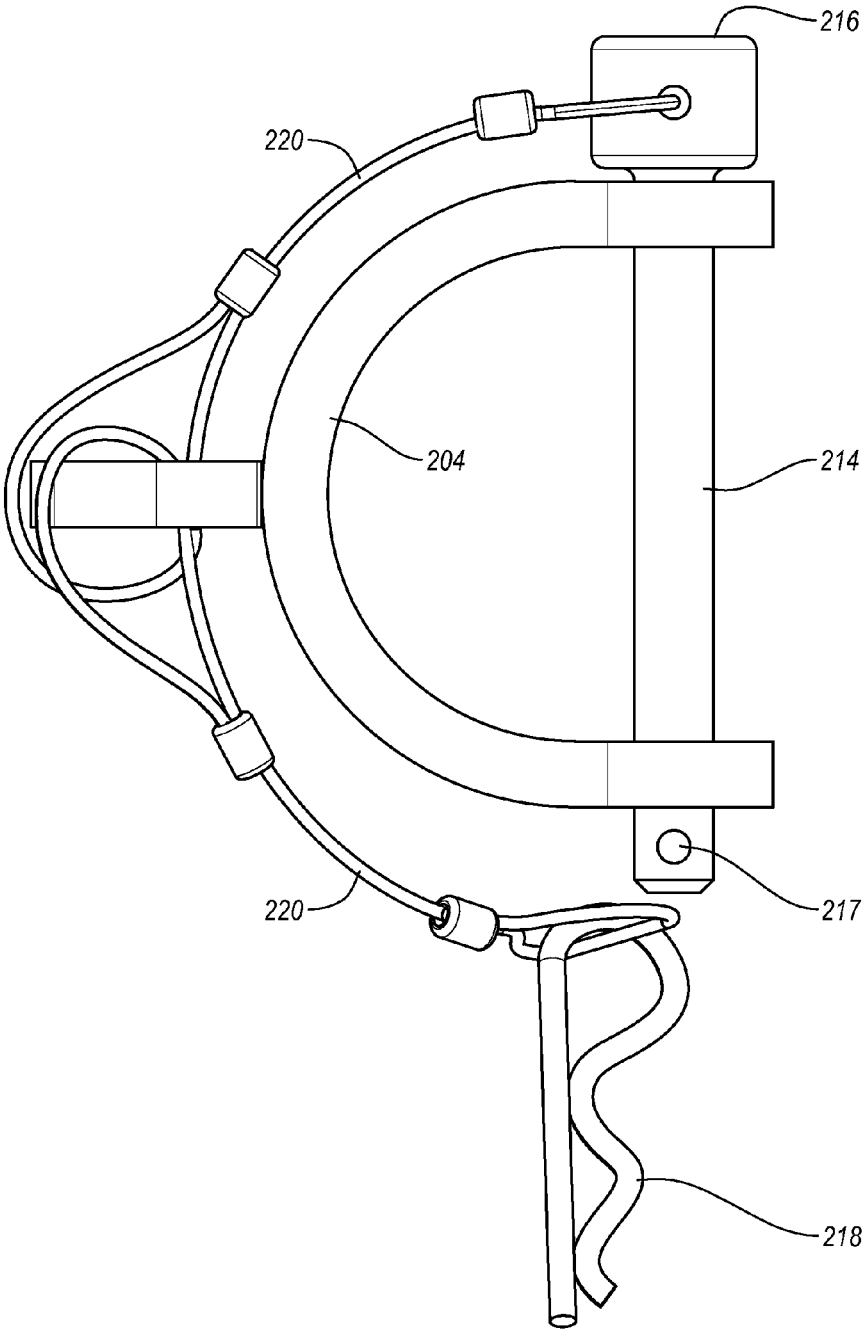
FIG. 9 illustrates a top view of a brace of a core barrel restraint in accordance with an implementation of the present invention.
Figure 10:
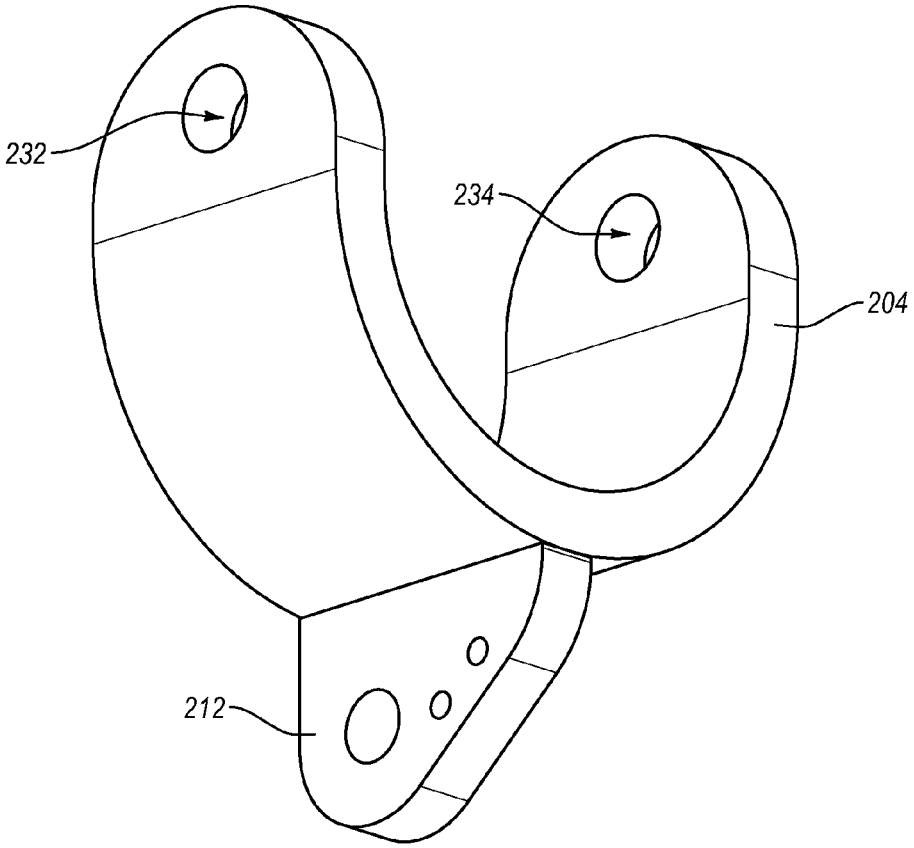
FIG. 10 illustrates a perspective view of the brace of FIG. 9.

Referring now to FIGS. 9-10 a number of features of the brace 204 will be described in greater detail. FIGS. 9-10 illustrates top and perspective views, respectively, of the brace 204. The brace 204 can comprise a high strength material, such as, for example, steel or other alloys or metals. In some implementations, the attachment flange 212 can be welded to the body of the brace 204.

As shown by FIGS. 9 and 10, in some implementations the body of the brace 204 can have a half circle shape. In alternative implementations, the brace 204 can comprise a full circular shape with a hinge that allows the brace 204 to be opened to receive the core barrel assembly 110. In one or more implementations, the brace 204 can be configured with a shape to correspond with the shape of the portion of the core barrel assembly to which it will be secured. In yet further implementations, the brace 204 can include a half-square, half-oval, or other geometric shape.

The brace 204 can further include locking mechanism adapted to operatively interface with the brace 204 to secure the brace 204 to the core barrel assembly 110. For example, FIG. 9 illustrates that the brace 204 can include a pin 214 configured to lock the brace 204 to a core barrel assembly 110. In alternative implementations, the brace 204 can include a latch or other mechanism adapted to lock the brace 204 to a core barrel assembly 110.

As shown in FIG. 10, the brace 204 can include a first pin hole 232 formed in a first portion or side of the brace 204 and a second pin hole 234 formed in an opposing portion or side. The pin holes 232 and 234 can be linearly aligned. Additionally, the pin holes 232 and 234 can be sized and configured to receive the pin 214. In some implementations, pin holes 232 and 234 can have a circular cross section to reduce point stresses and concentration of forces. In alternative implementations, the pin holes 232 and 234 can have a square, diamond, or other cross-sectional shapes. In any event, the pin holes 232 and 234 can correspond in size and shape with the pin 214.

A shown by FIG. 10 the cable attachment flanges 212 can include one or more holes or recesses for attachment to the cable 206. Additionally, as shown by FIG. 10, the cable attachment flange 212 secured to the brace 204 can include one or more additional holes or recesses for securing one or more tethers 220, 222 thereto. The tethers 220, 222 can be configured to retain the pin 214 and/or safety clip 218 to the brace 204.

One will appreciate in light of the disclosure herein that in one or more implementations the configuration of the brace 204 and its attachment to the core barrel assembly 110 can ensure that the pin 214 is loaded in double shear. The double shear loading of the pin 214 can provide the pin 214 with increased load capacity. This is due to the forces acting on the pin 214 being distributed to more than one location. Furthermore, in at least some implementations, the configuration of the brace 204 and pin 214 can be configured to reduce or eliminate the transfer of bending forces to the pin 214.

Furthermore, the design of the brace 204 can allow for favorable mechanical loading (shear and not bending) irrespective of the orientation of the core barrel assembly 110 relative to the overshoot assembly 132. Thus, the horseshoe and pin configuration of the brace 204 can provide a quick and easy form of attachment, while also providing a sure attachment.

Referring now to FIG. 9, the pin 214 can include a head 216. The head 216 can be larger in size than the body of the pin 214. In particular, the head 216 can be too large to pass through the pin holes 232, 234 of the brace 204. Thus, the head 216 can prevent the pin 214 from being pulled or pushed completely through the pin holes 232, 234 of the brace 204. Furthermore, FIG. 9 illustrates in some implementations the head 216 can include a recess to receive a portion of a tether 220. The tether 220 can help ensure that the pin 214 remains with the brace 204.

The end of the pin 214 opposite the head 214 can include a recess 217 for receiving a safety clip 218, such as, for example, an R-clip. The safety clip 218 can prevent the pin 214 from being pulled back through the brace 204 during use. Additionally, the safety clip 218 can be coupled to the brace 204 by a tether 220.

In some implementations, the body of the pin 214 can have a circular cross section to reduce point stresses and concentration of forces. In alternative implementations, the body of the pin 214 can have a square, diamond, or other cross-sectional shapes. In any event, the body of the pin 214 can correspond in size and shape to the pin holes 232 and 234 of the brace 204.

To secure the brace 204 to a core barrel assembly 110, an operator can position the brace 204 about a portion of the core barrel assembly 110. The operator can then insert the pin 214 through a pin hole 232, through a through hole of the core barrel assembly 110, and through the other pin hole 234. The user can then insert the safety clip 218 through the recess 217 of the pin 214.

One will appreciate in light of the disclosure herein that the configuration of the brace 204 can allow an operator to quickly and easily attach the brace 204 to a core barrel assembly 110. In particular, the pin 214 can allow an operator to couple the brace 204 to a core barrel assembly 110 without the use of any threaded fasteners or other devices that are time consuming to assemble. Indeed, as discussed above, an operator need only slip the pin 214 through the brace 204 and the core barrel assembly 110 and insert the safely clip 218 into the pin 214 to attach the brace 204 to a core barrel assembly 110.

One will appreciate in light of the disclosure herein that the core barrel restraint device 200 can allow for easy and quick connection to an overshot assembly and a core barrel assembly. This is in contrast to some safety devices that require significant time and effort to use, thereby increasing the likelihood that operators will choose to forego their use in the field. In addition, the core barrel restraint device 200 can function irrespective of the orientation of the core barrel assembly 110 relative to the overshot assembly 132.

The present invention may be embodied in other specific forms without departing from its spirit or essential characteristics. For example, the restraint 200 can also be adapted to serve as a general secondary fall restraint for any lifting operations, i.e. overhead and mobile cranes. The cup could be placed over the crane cable or hook and a brace device attached to the item being lifted. In the event the hook or primary lifting point on the item being lifted fails, the restraint device will prevent the item from falling uncontrollably. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. An apparatus comprising:
an overshot assembly having an associated wireline, and
a core barrel restraint assembly further comprising:
a brace sized and adapted to attach to a core barrel assembly;
a cup sized and adapted to attach to at least one of the overshot assembly or the associated wireline; and
a cable connecting said brace to said cup;
wherein the core barrel restraint assembly is configured to operatively connect to a core barrel assembly and to the overshot assembly, the overshot assembly having an overshot latch mechanism, and
wherein the core barrel restraint assembly is configured to prevent the core barrel assembly from failing upon failure of the overshot latch mechanism.

2. The apparatus as recited by claim 1, wherein the cup comprises a generally hollow cylinder.

3. The apparatus as recited by claim 2, wherein the cup comprises an angled slot extending from a top end to a bottom end of the generally hollow cylinder.

4. The apparatus as recited by claim 3, wherein the angled slot is oriented between about 15 degrees and about 40 degrees relative to a central axis of said cup.

5. The apparatus as recited by claim 3, further comprising a retaining plate positioned about the top end of said cup.

6. The apparatus as recited by claim 5, wherein the retaining plate includes a slot extending from the angled slot and about a central axis of said cup.

7. The apparatus as recited by claim 6, wherein the retaining plate is adapted to maintain at least one of the wireline or the overshot assembly in line with the central axis of the cup.

8. The apparatus as recited by claim 1, further comprising a locking mechanism adapted to operatively interface with the brace to secure the brace to the core barrel assembly.

9. The apparatus as recited by claim 8, wherein the locking mechanism further comprises a pin adapted to extend through the brace to lock the brace to the core barrel assembly.

10. The apparatus as recited by claim 9, wherein the locking mechanism further comprises a clip adapted to prevent the pin from being inadvertently withdrawn from the brace.

11. The apparatus as recited by claim 10, wherein the locking mechanism further comprises at least one tether securing the pin and said clip to the brace.

12. A drilling system comprising:
a core barrel assembly;
an overshot assembly having an overshot latch mechanism adapted to couple said overshot assembly to said core barrel assembly; and
a core barrel restraint comprising:
a cup secured about said overshot assembly,
a brace secured to said core barrel assembly, and
a cable directly coupling said brace and said cup.

13. The drilling system as recited by claim 12, wherein the cup comprises a generally hollow cylinder.

14. The drilling system as recited by claim 13, wherein the cup comprises an angled slot extending from a top end to a bottom end of the generally hollow cylinder.

15. The drilling system as recited by claim 12, further comprising a pin adapted to extend through the brace and the core barrel assembly.

16. The drilling system as recited by claim 15, further comprising a clip adapted to prevent the pin from being inadvertently withdrawn from the brace.

17. A method of retrieving a core sample, comprising:

retracting an overshot and a core barrel assembly from a drill string until at least a portion of the core barrel assembly is removed from the drill string;

securing a cup about the overshot; and securing a brace to the core barrel assembly;

wherein the brace is directly secured to the cup via a cable.

18. The method as recited by claim 17, further comprising:

angling the cup relative to a rod of the overshot assembly or a wireline;

positioning the cup on the rod of the overshot assembly or the wireline by passing the rod of the overshot assembly or the wireline into an angled slot.

19. The method as recited by claim 17, further comprising inserting a pin through the brace and the core barrel assembly.

20. The method as recited by claim 19, further comprising inserting a clip through an end of the pin, the clip preventing the pin from passing back through the brace.

* * * * *